US005632678A

United States Patent [19]

Doelfel

[11] Patent Number: 5,632,678

[45] Date of Patent: May 27, 1997

[54] ROOF VENT FOR A CLOTHES DRYER

[76] Inventor: John G. Doelfel, 103 Kirtland Dr., Naples, Fla. 33942

[21] Appl. No.: 654,223

[22] Filed: May 28, 1996

[51] Int. Cl.[6] ..... F24F 7/02

[52] U.S. Cl. ..... 454/366; 454/367

[58] Field of Search ..... 454/3, 355, 359, 454/366, 367

[56] References Cited

U.S. PATENT DOCUMENTS

| | | | |
|---|---|---|---|
| 2,741,972 | 4/1956 | Pryne | 454/366 X |
| 2,885,944 | 5/1959 | Bates | 454/366 |
| 4,625,630 | 12/1986 | Carroll et al. | 454/366 X |
| 5,046,408 | 9/1991 | Eugenio | 454/359 |
| 5,402,611 | 4/1995 | Vagedes | 454/366 X |
| 5,547,422 | 8/1996 | Seboldt | 454/359 |

*Primary Examiner*—Harold Joyce
*Attorney, Agent, or Firm*—Werner Schroeder

[57] ABSTRACT

A roof vent which is mounted on a roof to vent a clothes dryer. According to the roof vent, a screen is located to the outside of the vent and it is hinged thereto at a forward edge of the vent to completely enclose the space that is formed between the opening and the base plate of the vent. Because of this hinge, the screen may swing upwardly for easy cleaning. There is also a provision for locking the screen in its closed position to prevent rattling and to prevent dislodging by other forces, such as, animals or high winds.

7 Claims, 2 Drawing Sheets

ROOF VENT FOR A CLOTHES DRYER

FIELD OF THE INVENTION

The present invention relates to a vent which is placed on the roof of a house over the upstanding pipe that is connected to a clothes dryer. The shape of the vent is in the form of a duct that is formed into an elbow so that the opening of the duct is facing downwardly toward the surface of the roof but spaced therefrom to keep the rainwater from entering.

BACKGROUND OF THE INVENTION

The above noted vent has a screen therein, normally placed at a horizontal plane. The purpose of the screen is to prevent. birds or other animals, such as vermins, from entering the duct and to proceed into the house. However, it has been found that this screen has the disadvantage of collecting lint coming from below because this lint is being expelled by the clothes dryer in its air stream passing therethrough. consequently, the efficiency of the dryer is diminished because the flow of the air stream is impeded as it tries to pass through the screen. This build-up of lint on the screen can become so bad until the dryer can not function at all anymore because the hot and moist air remains in the dryer. This results in a great expenditure of energy because the dryer may run at double the time it was designed for if not more.

During a database search of patents, no references were found that would address the above noted problem.

U.S. Pat. No. 5,147,244 is concerned with a roof vent located at the ridge of the roof including a control apparatus therefor, but it is designed to vent the whole of a building and not a single appliance.

U.S. Pat. No. 4,546,919 is concerned with a ventilator actuator to control the internal temperature of a building.

OBJECT OF THE INVENTION

Most homeowners are not aware that the screen in the roof vent should be cleaned periodically, they note the low performance of the clothes dryer and may try to find the cause of the malfunction in the dryer itself. If not skilled in the maintenance or repair of this type appliance, the homeowner may call in an expert to analyze and repair the problem. It has been found that it is extremely difficult to clean the screen in the vents that are commonly installed on the roof. The screens are not removable at all and are not easily accessible from the outside because of the bend of the channel toward the roof. The vent duct cannot be removed because the base plate of the duct is placed under the shingles so that rainwater easily flows over the shingles. It is therefore an object of the invention to alleviate the problem by relocating the screen to the outside of the vent and to make it movable and easily accessible.

DETAILED DESCRIPTION OF THE DRAWINGS

Figure 1:
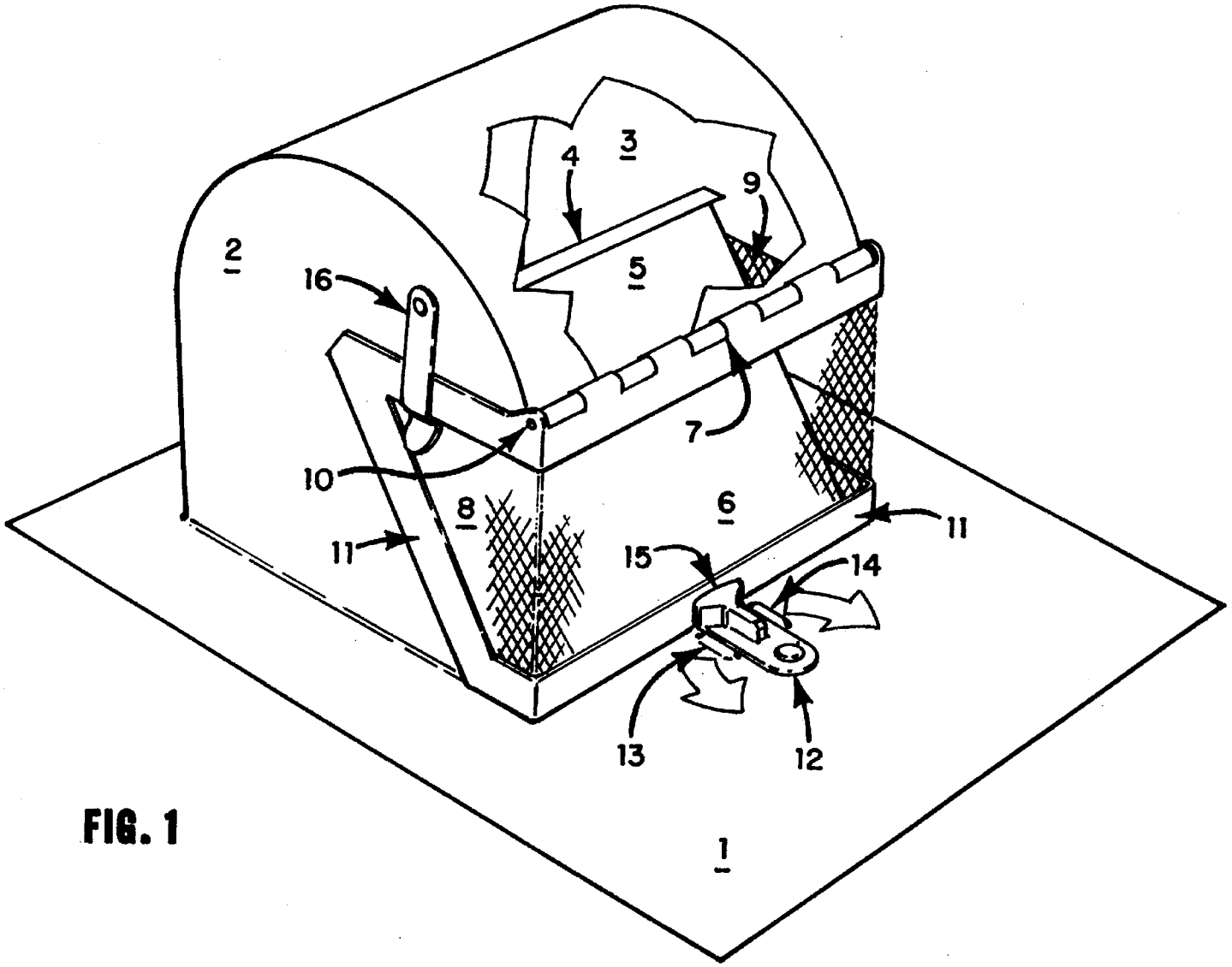
FIG. 1 shows the roof vent with its movable screen in its closed position.
Figure 2:
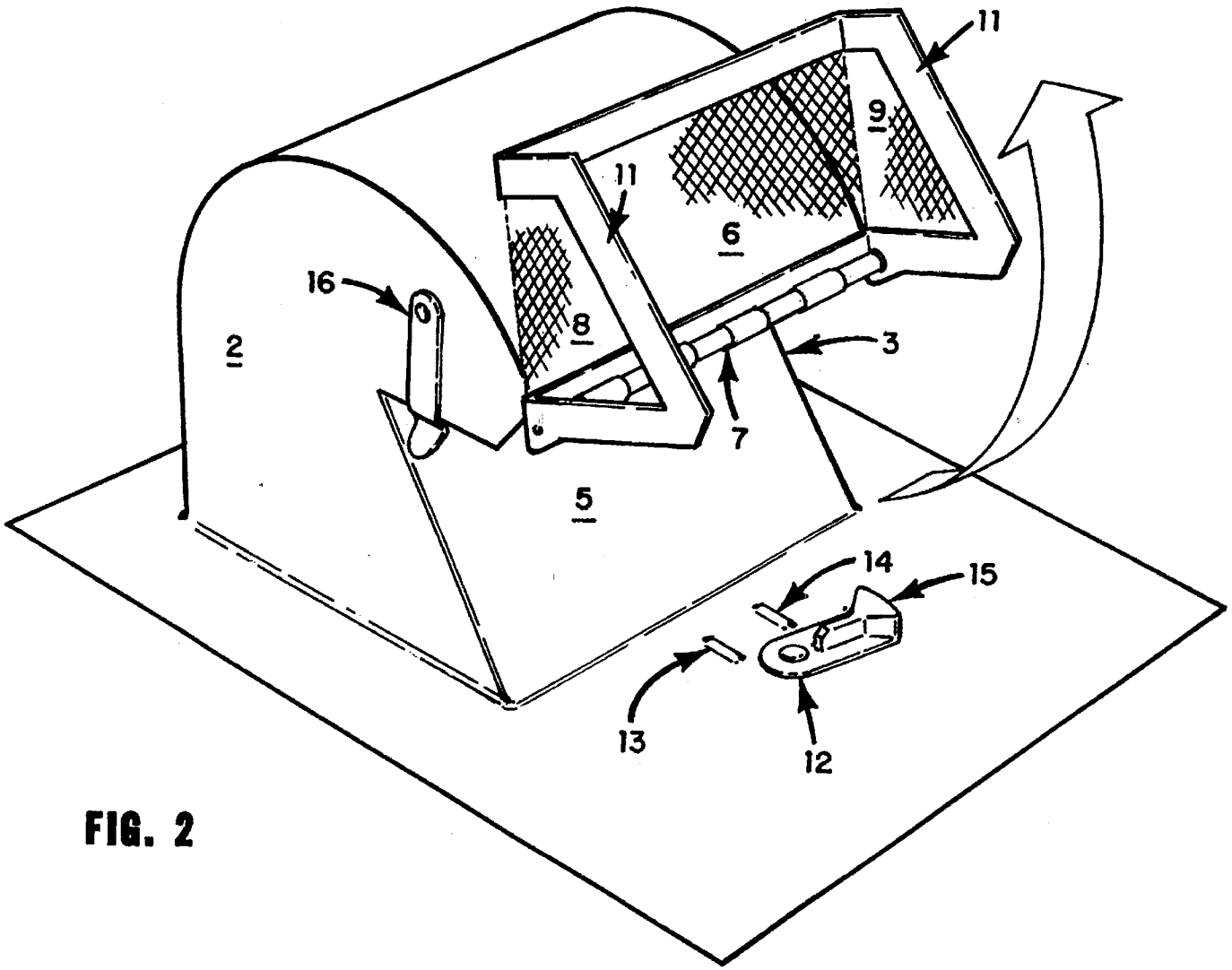
FIG. 2 shows the roof vent with its movable screen in its open position

FIG. 1 shows the typical roof vent as it is installed on the roof when the house is being built or as retrofit when a clothes dryer is installed at a later time. When installing the vent, the vent duct is placed over a pipe (not shown) coming from the dryer and penetrating through the roof. The base plate 1 of the vent duct is placed over the pipe and secured to the roof surface. As can be seen from both Figrs., the duct is a channel and is elbow-shaped and has an opening facing toward the roof. The purpose of this shape is to keep rainwater from entering the duct for obvious reasons. The duct has two side walls 2 and 3. In FIG. 1, in a break-away there is shown a ledge 4 which constitutes the top of a forwardly facing wall 5 of the basic duct. At this ledge 4, there normally is located a screen (not shown) which serves the purpose of keeping animals out of the duct. However, as explained above, the screen also happens to catch the lint entrained in the air stream coming from the dryer. As can be seen in FIG. 1, the screen 6 has now been moved to a forward position to completely enclose the forward part of the duct. The screen is hinged at the forward edge of the elbow of the duct by a hinge 7. The screen is further bent back at 8 and 9 to compliment the side walls 2 and 3 of the vent duct and to thereby completely enclose the opening of the duct. In FIG. 2, it can be seen that the screen can be swung up to a position where it is easily accessible from both sides for cleaning purposes. The hinge 7 may take many forms and they are not material to the invention. The hinge could be formed by the materials themselves involved in the construction. The hinge could be a separate hinge made of plastic material or rustproof metal. In the hinge shown in FIG. 1, the pintle 10 should be plastic or at least rust-proof metal so as to prolong the life of the vent. Likewise, the material of the screen should be rust-proof for obvious reasons, such as aluminum or plastic. In FIGS. 1 and 2, the screen is shown as being bordered by a frame 11. However, this frame is not absolutely necessary because the screen material could be of such a weight so as to be self sustaining. The material could be doubled back at its edges to form its own frame. All that is required is that the screen in its final form be somewhat rigid or sturdy. It is preferred that the screen, once it is brought from its open position to a closed position, be locked in place so that outside forces cannot move the same, such as animals or gusty winds. There are many ways of achieving this locking feature. Both FIGS. show a latch 12 which is rotatably mounted on base plate 1 and is kept in a locked position by detents 13 and 14 which could be pressed out of the material of base plate 1. The forward nose 15 of latch 12 keeps the screen in a locked position. Instead of the latch 12, spring clips 16 can be used which are stationarily mounted on side walls 2 and 3. The latter version is preferred because the spring clips 16 hold the screen firmly against the side walls 2 and 3 and prevent rattling when there are gusty winds swirling around the roof. It is now clear that the structure of this invention can conveniently and easily be serviced by lay persons. It also has been found that the way the screen surrounds the opening of the vent duct, the device is self cleaning because strong gusts of winds may blow through the screen from three different sides and blow away whatever is lodged in there.

What I claim is:

1. A roof vent for venting a clothes dryer, said vent having a base plate being mounted to a surface of a roof and an upstanding elbow-shaped duct mounted thereon and having an opening facing downwardly toward said plate and forming a space there between, said duct having two side walls and a forward edge between said side walls and normal thereto, the improvement comprising: a moveable screen mounted on the outside of said duct so that the space between said opening and said plate and said two side walls is completely enclosed.

2. The vent as claimed in claim 1, wherein said screen is made moveable by a hinge connected between said forward edge and and said screen, whereby the screen may swing upwardly.

3. The vent as claimed in claim 1, wherein said screen has a front and two sides bent back therefrom so as to compliment said side walls of said duct.

4. The vent as claimed in claim 1, wherein said screen has a frame around its edges.

5. The vent as claimed in claim 1, including means for locking said screen in its closed position.

6. The vent as claimed in claim 5, wherein said means for locking is a rotatable latch mounted on said base plate in front of said screen.

7. The vent as claimed in claim 5, wherein said means for locking are two spring clips each mounted on each one of said side walls so as to receive respective edges of said screen between said spring clips and said side walls.

* * * * *